US005579596A

United States Patent [19]

Kovacs et al.

[11] Patent Number: 5,579,596

[45] Date of Patent: Dec. 3, 1996

[54] ADJUSTABLE FRAME

[76] Inventors: Lajos Kovacs, Vorostorony UTCA 9/a., Budapest, Hungary, 1025; Sandor Janoskuti, Harsfa U. 1., Nagykovacsi, Hungary, 2094; Nathanael Nichols, 7600 Locust Ave., Gary, India. 46403

[21] Appl. No.: 368,896

[22] Filed: Jan. 5, 1995

[51] Int. Cl.[6] ..... G09F 1/12

[52] U.S. Cl. ..... 40/739; 40/783

[58] Field of Search ..... 40/155, 156, 152, 40/152.1, 159.1; 403/401, 402

[56] References Cited

U.S. PATENT DOCUMENTS

| | | | |
|---|---|---|---|
| 579,243 | 3/1897 | Schulze | 40/156 X |
| 996,915 | 7/1911 | Engelmohr | 40/155 |
| 1,421,301 | 6/1922 | Petrow | 40/155 |
| 2,790,259 | 4/1957 | Havens | 40/155 |
| 4,630,386 | 12/1986 | Wilson | 40/155 |
| 4,718,184 | 1/1988 | Sherman | 40/155 |
| 4,922,638 | 5/1990 | Litvak et al. | 40/155 |
| 4,974,352 | 12/1990 | Chen | 40/155 X |
| 4,982,517 | 1/1991 | Bilodeau | 40/155 |
| 5,058,297 | 10/1991 | McGinnis | 40/155 |
| 5,090,835 | 2/1992 | Cox . | |
| 5,187,886 | 2/1993 | Wu et al. | 40/156 X |

FOREIGN PATENT DOCUMENTS

| | | | |
|---|---|---|---|
| 3503754 | 8/1986 | Germany | 40/152 |

*Primary Examiner*—Joanne Silbermann

[57] ABSTRACT

A picture frame for adjustably surrounding a picture. The inventive device includes a plurality of corner members each having a projecting leg extending therefrom. Each corners member is configured to adjustably receive therethrough the projecting leg of an adjacent corner member such that four corner members can be coupled together to form a frame adjustable to a desired size.

9 Claims, 4 Drawing Sheets

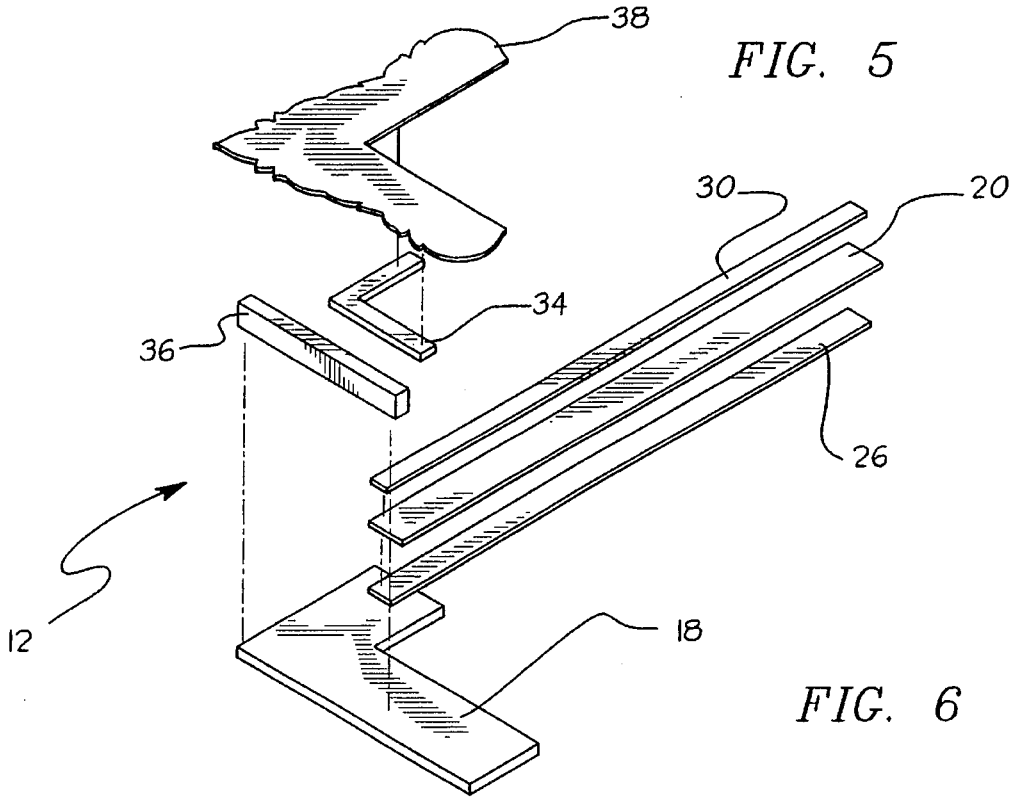
FIG. 5
FIG. 6
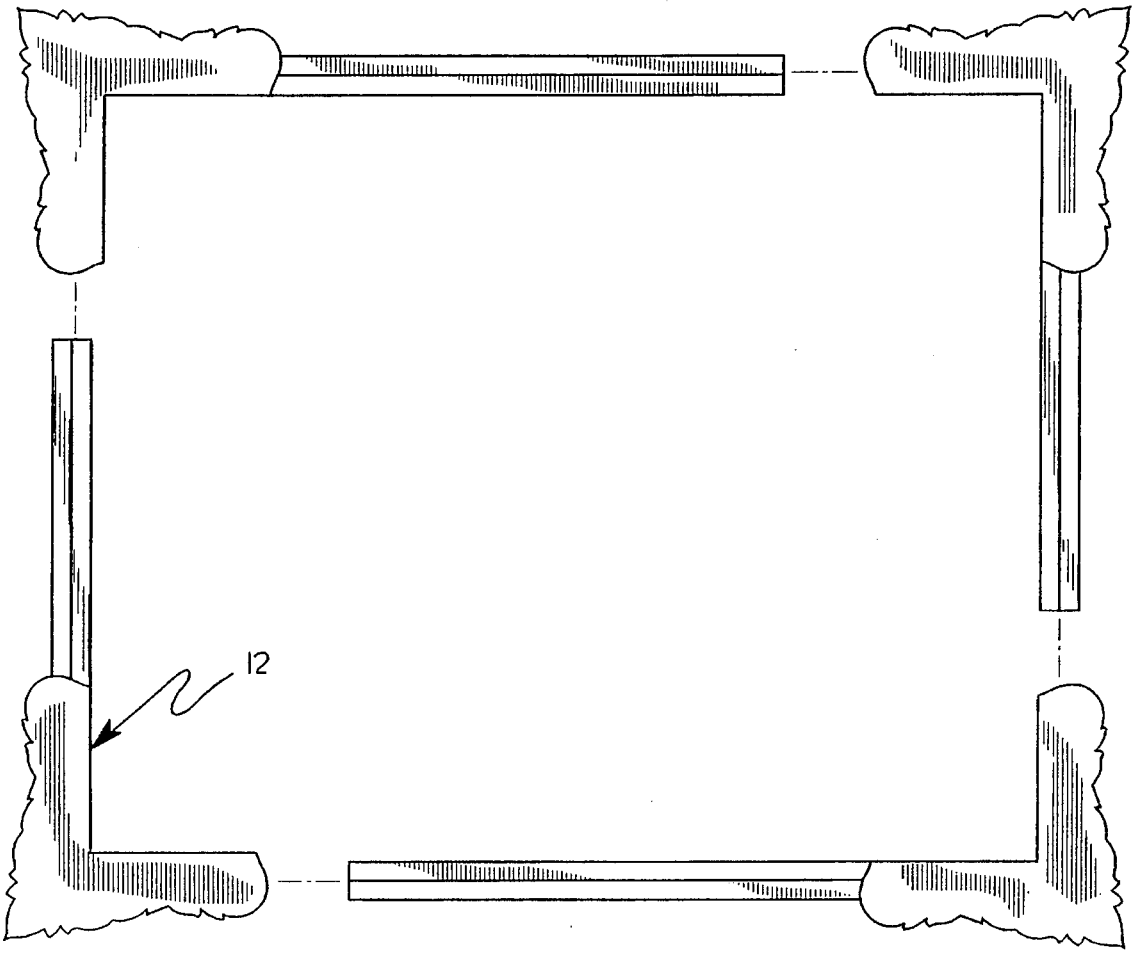

ADJUSTABLE FRAME

BACKGROUND OF THE INVENTION

1. Field of the Invention

The present invention relates to picture frames and more particularly pertains to a modular picture frame for adjustably surrounding a picture.

2. Description of the Prior Art

The use of picture frames is known in the prior art. More specifically, picture frames heretofore devised and utilized are known to consist basically of familiar, expected and obvious structural configurations, notwithstanding the myriad of designs encompassed by the crowded prior art which have been developed for the fulfillment of countless objectives and requirements.

Known prior art picture frames include U.S. Pat. No. 5,090,835; U.S. Pat. No. 5,058,297; U.S. Pat. No. 4,982,517; U.S. Pat. No. 4,922,638; and U.S. Pat. No. 4,718,184.

While these devices fulfill their respective, particular objectives and requirements, the aforementioned patents do not disclose a picture frame for adjustably surrounding a picture which includes a plurality of corner members each having a projecting leg extending therefrom, wherein each corners member is configured to adjustably receive therethrough the projecting leg of an adjacent corner member such that four corner members can be coupled together to form a frame adjustable to a desired size.

In these respects, the modular frame according to the present invention substantially departs from the conventional concepts and designs of the prior art, and in so doing provides an apparatus primarily developed for the purpose of adjustably surrounding a picture.

SUMMARY OF THE INVENTION

In view of the foregoing disadvantages inherent in the known types of picture frames now present in the prior art, the present invention provides a new modular frame construction wherein the same can be utilized for adjustably surrounding a picture. As such, the general purpose of the present invention, which will be descried subsequently in greater detail, is to provide a new modular frame apparatus and method which has many of the advantages of the picture frames mentioned heretofore and many novel features that result in a modular frame which is not anticipated, rendered obvious, suggested, or even implied by any of the prior art picture frames, either alone or in any combination thereof.

To attain this, the present invention generally comprises a picture frame for adjustably surrounding a picture. The inventive device includes a plurality of corner members each having a projecting leg extending therefrom. Each corners member is configured to adjustably receive therethrough the projecting leg of an adjacent corner member such that four corner members can be coupled together to form a frame adjustable to a desired size.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new modular frame apparatus and method which has many of the advantages of the picture frames mentioned heretofore and many novel features that result in a modular frame which is not anticipated, rendered obvious, suggested, or even implied by any of the prior art picture frames, either alone or in any combination thereof.

It is another object of the present invention to provide a new modular frame which may be easily and efficiently manufactured and marketed.

It is a further object of the present invention to provide a new modular frame which is of a durable and reliable construction.

An even further object of the present invention is to provide a new modular frame which is susceptible of a low cost of manufacture with regard to both materials and labor, and which accordingly is then susceptible of low prices of sale to the consuming public, thereby making such modular frames economically available to the buying public.

Still yet another object of the present invention is to provide a new modular frame which provides in the apparatuses and methods of the prior art some of the advantages thereof, while simultaneously overcoming some of the disadvantages normally associated therewith.

Still another object of the present invention is to provide a new modular frame for adjustably surrounding a picture.

Yet another object of the present invention is to provide a new modular frame which includes a plurality of corner members each having a projecting leg extending therefrom. Each corners member is configured to adjustably receive therethrough the projecting leg of an adjacent corner member such that four corner members can be coupled together to form a frame adjustable to a desired size.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an exploded isometric illustration of a corner member.

FIG. 6 is an exploded front elevation view of the invention.

DESCRIPTION OF THE PREFERRED EMBODIMENT

Figure 1:
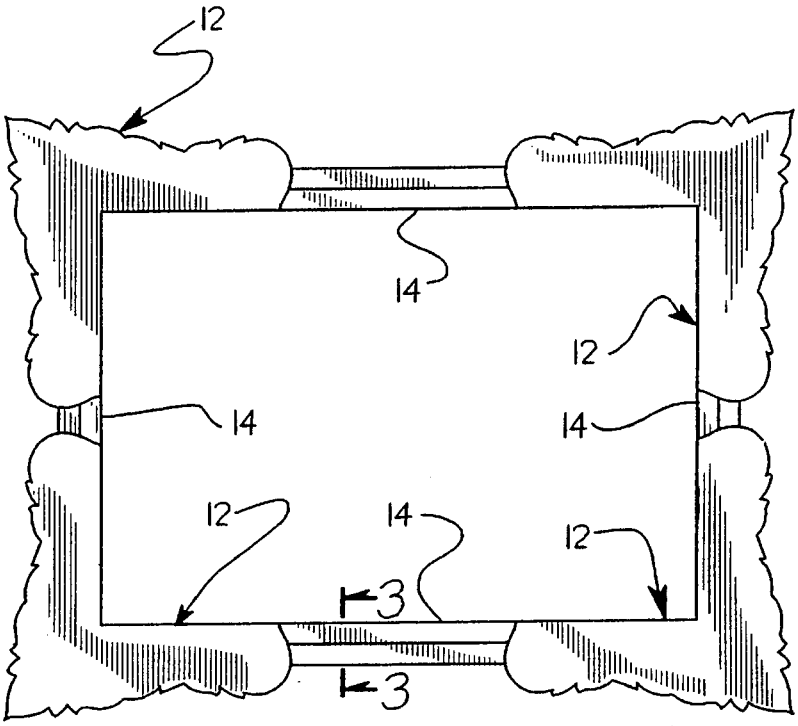
FIG. 1 is a front elevational view of a modular frame according to the present invention.

With reference now to the drawings, and in particular to FIGS. 1–8 thereof, a new modular frame embodying the principles and concepts of the present invention and generally designated by the reference numeral 10 will be described.

Figure 2:
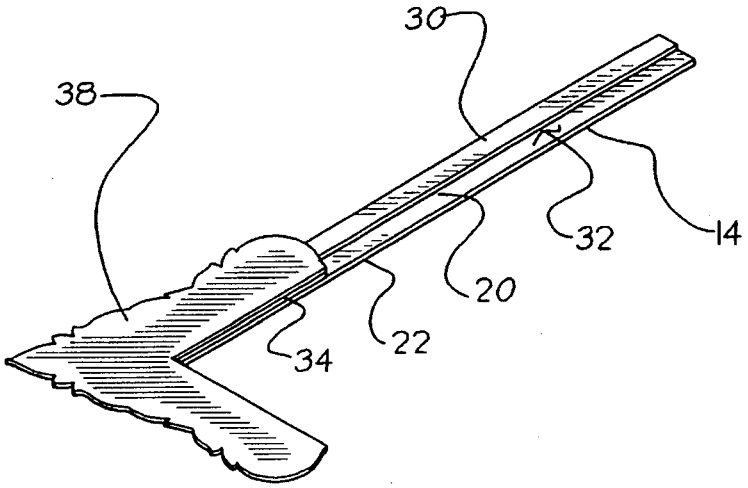
FIG. 2 is an isometric illustration of the present invention.

More specifically, it will be noted that the modular frame 10 comprises a plurality of corner members 12 each having a projecting leg 14 extending therefrom, and shaped so as to define a receiving aperture 16 oriented substantially orthogonally relative to the projecting leg, as shown in FIGS. 1 and 2. The projecting leg 14 of a first corner member 12 can thus be slidably positioned within the receiving aperture 16 of a second corner member, with the projecting leg of the second corner member being slidably positioned within the receiving aperture of a third corner member. Similarly, the projecting leg 14 of the third corner member 12 can be slidably positioned within the receiving aperture of a fourth corner member, with the projecting leg of the fourth corner member being slidably positioned within the receiving aperture of the first corner member to complete the rectangular configuration of the modular frame 10. The corner members 12 can then be slidably adjusted relative to one another to size the frame 10 to fit a particular unillustrated picture to be framed.

As illustrated in FIGS. 2 through 5, it can be shown that each of the corner members 12 comprises a base plate 18 to which the projecting leg 14 is coupled. The projecting leg 14 comprises an elongated planar member 20 having an interior edge 22 spaced from and oriented parallel to an exterior edge 24 to define the substantially elongated rectangular shape of the planar member. A lower longitudinal ridge 26 is coupled to a lower surface of the planar member 20 proximal to the interior edge 22 and cooperates therewith to define a lower slot 28 extending longitudinally along the projecting leg 14. Similarly, an upper longitudinal ridge 30 is coupled to an upper surface of the planar member 20 proximal to the exterior edge 24 and cooperates therewith to define an upper slot 32 extending longitudinally along the projecting leg 14. When the device 10 is assembled, the lower slots 28 of adjacent projecting legs cooperate to define a rectangular recess within which the edges of a picture can be positioned.

Figure 3:
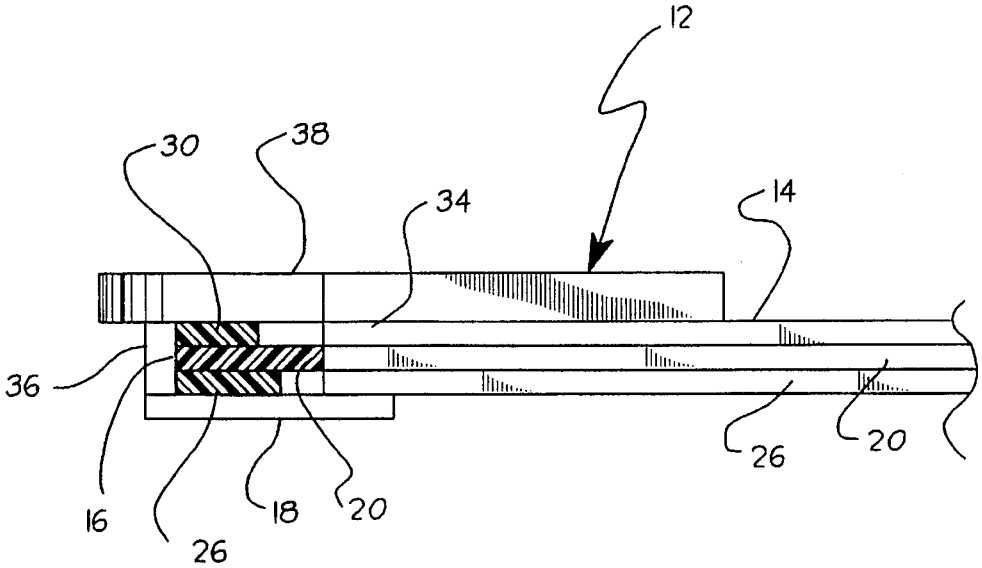
FIG. 3 is a cross sectional view taken along line 3—3 of FIG. 1.
Figure 4:
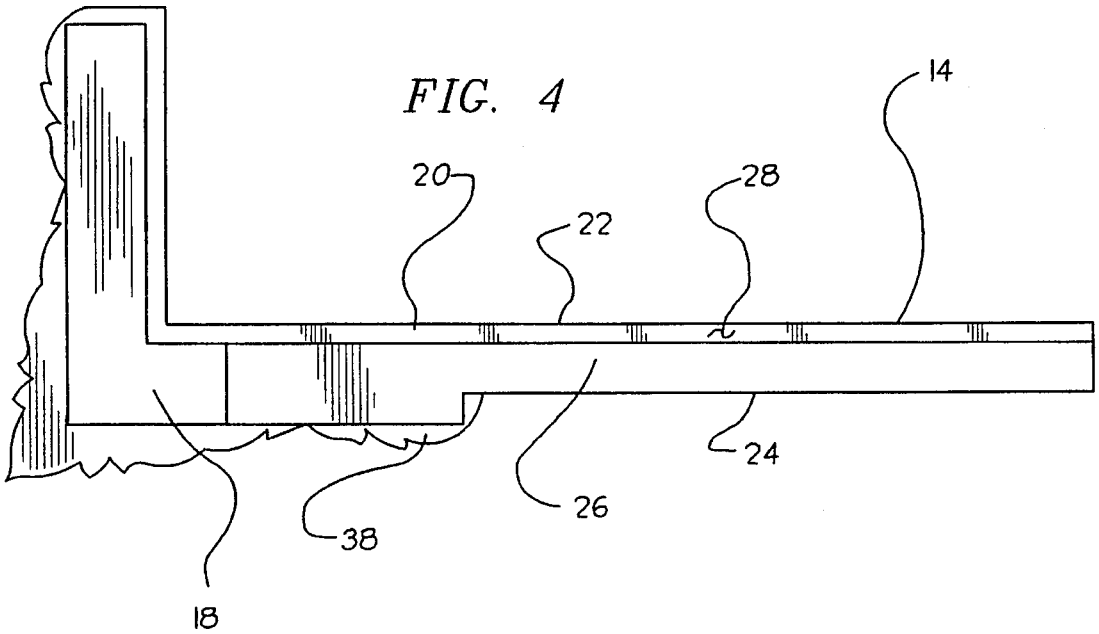
FIG. 4 is a bottom plan view of a corner member of the invention.

As best illustrated in FIGS. 3 and 5, the corner members 12 each further comprise an L-shaped spacer 34 coupled to the projecting leg 14 so as to capture the projecting leg between the base plate 18 and the L-shaped spacer. A transverse spacer 36 is coupled to the base plate 18 and oriented so as to extend in a substantially spaced and parallel orientation relative to a portion of the L-shaped spacer 34. To complete the receiving aperture 16 of each of the corner members 12, a cover plate 38 extends over the transverse spacer 36 and the L-shaped spacer 34 so as to capture the projecting leg 14, the L-shaped spacer 34, and the transverse spacer 36 between the base plate 18 and the cover plate 38. By this structure, the projecting leg 14 of one of the corner members 12 can be received within the cooperatively configured receiving aperture 16 of another one of the corner members to slidably couple the corner members together.

Figure 7:
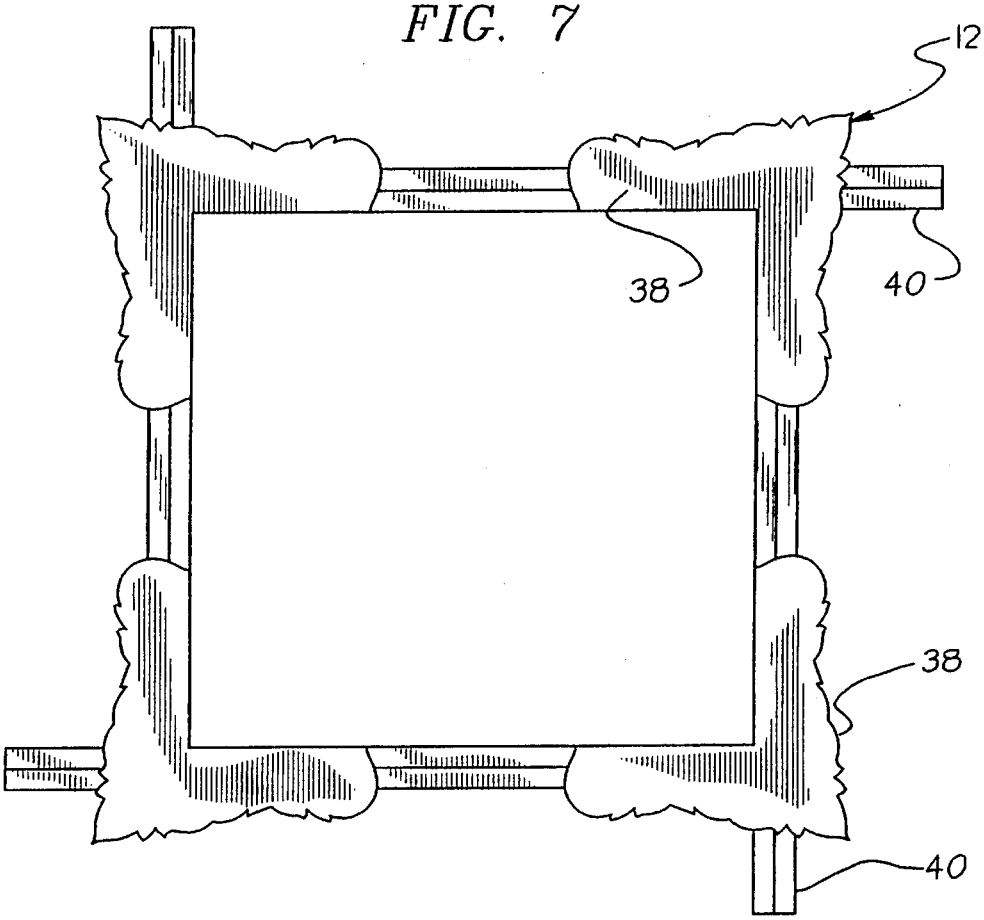
FIG. 7 is a front elevation of the present invention in an assembled configuration prior to removal of excess material of the projecting legs.
Figure 8:
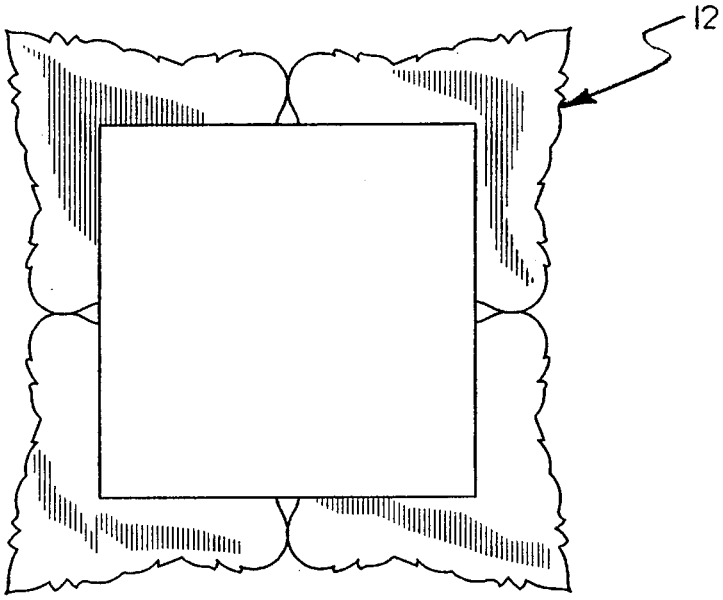
FIG. 8 is a front elevation view illustrating an adjustability of the invention.

As shown in FIGS. 6 and 7, the corner members 12 can be slidably engaged to one another to form a rectangular picture frame of a desired size. Excess material 40 of the projecting legs 14 can then be cut or broken away to reduce the length of the projecting legs 14 such that distal ends thereof are concealed by the cover plates 38 of adjacent corner members 12. As shown in FIG. 7, the invention 10 can be slidably positioned such that the cover plates 38 of adjacent corner members 12 are positioned into an abutting relationship to accommodate a relatively small picture.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A modular frame comprising:

a plurality of corner members each having a projecting leg extending therefrom, the corner members each being shaped so as to define a receiving aperture oriented substantially orthogonally relative to the projecting leg, wherein each of the corner members comprises a base plate, with the projecting leg being coupled to and extending from the base plate; an L-shaped spacer coupled to the projecting leg so as to capture the projecting leg between the base plate and the L-shaped spacer; a transverse spacer coupled to the base plate and oriented so as to extend in a substantially spaced and parallel orientation relative to a portion of the L-shaped spacer; and a cover plate extending over the transverse spacer and the L-shaped spacer so as to capture the projecting leg, the L-shaped spacer, and the transverse spacer between the base plate and the cover plate.

2. The modular frame of claim 1, wherein the projecting leg of each of the corner members comprises an elongated planar member having an interior edge spaced from and oriented parallel to an exterior edge to define a substantially elongated rectangular shape of the planar member; and a lower longitudinal ridge coupled to a lower surface of the planar member proximal to the interior edge and cooperating therewith to define a lower slot extending longitudinally along the projecting leg, wherein the lower slots of adjacent projecting legs cooperate to define a rectangular recess within which the edges of a picture can be positioned.

3. The modular frame of claim 2, wherein the projecting leg of each of the corner members further comprises an upper longitudinal ridge coupled to an upper surface of the planar member proximal to the exterior edge thereof and cooperating therewith to define an upper slot extending longitudinally along the projecting leg.

4. A method of assembling the modular frame of claim 1, the method comprising the steps of:

(a) providing the apparatus;

(b) positioning the projecting leg of a first one of the corner members within the receiving aperture of a second one of the corner members;

(c) positioning the projecting leg of the second corner member within the receiving aperture of a third one of the corner members;

(d) positioning the projecting leg of the third corner member within the receiving aperture of a fourth one of the corner members; and, (e) positioning the projecting leg of the fourth corner member within the receiving aperture of the first corner member.

5. The method of assembling a modular frame of claim 4, and further comprising the steps of:

(f) adjusting said corner members relative to one another to size the modular frame to fit a picture.

6. The method of assembling a modular frame of claim 5, and further comprising the steps of:

(g) removing excess material of the projecting legs extending beyond adjacent corner members.

7. A modular frame comprising:

a plurality of corner members each having a projecting leg extending therefrom, the corner members each being shaped so as to define a receiving aperture oriented substantially orthogonally relative to the projecting leg, wherein the projecting leg of a first one of the corner members can thus be slidably positioned within the receiving aperture of a second one of the corner members, with the projecting leg of the second corner member being slidably positioned within the receiving aperture of a third one of the corner members, the projecting leg of the third corner member being slidably positioned within the receiving aperture of a fourth one of the corner members, with the projecting leg of the fourth corner member being slidably positioned within the receiving aperture of the first corner member to define a substantially rectangular configuration of the modular frame, each of the corner members being slidably adjustable relative to one another to size the modular frame, wherein each of the corner members comprises a base plate, with the projecting leg being coupled to and extending from the base plate; an L-shaped spacer coupled to the projecting leg so as to capture the projecting leg between the base plate and the L-shaped spacer; a transverse spacer coupled to the base plate and oriented so as to extend in a substantially spaced and parallel orientation relative to a portion of the L-shaped spacer; and a cover plate extending over the transverse spacer and the L-shaped spacer so as to capture the projecting leg, the L-shaped spacer, and the transverse spacer between the base plate and the cover plate.

8. The modular frame of claim 7, wherein the projecting leg of each of the corner members comprises an elongated planar member having an interior edge spaced from and oriented parallel to an exterior edge to define a substantially elongated rectangular shape of the planar member; and a lower longitudinal ridge coupled to a lower surface of the planar member proximal to the interior edge and cooperating therewith to define a lower slot extending longitudinally along the projecting leg, wherein the lower slots of adjacent projecting legs cooperate to define a rectangular recess within which the edges of a picture can be positioned.

9. The modular frame of claim 8, wherein the projecting leg of each of the corner members further comprises an upper longitudinal ridge coupled to an upper surface of the planar member proximal to the exterior edge thereof and cooperating therewith to define an upper slot extending longitudinally along the projecting leg.

* * * * *